United States Patent [19]

Kato

[11] Patent Number: 4,717,856

[45] Date of Patent: Jan. 5, 1988

[54] CATHODE RAY TUBE HAVING AN ALUMINUM OXIDE FILM OVER A BLACK MATRIX

[75] Inventor: Hiroshi Kato, Shinagawa, Japan

[73] Assignee: Sony Corporation, Tokyo, Japan

[21] Appl. No.: 833,393

[22] PCT Filed: Jun. 13, 1985

[86] PCT No.: PCT/JP85/00332

§ 371 Date: Feb. 25, 1986

§ 102(e) Date: Feb. 25, 1986

[87] PCT Pub. No.: WO86/00467

PCT Pub. Date: Jan. 16, 1986

[30] Foreign Application Priority Data

Jun. 28, 1984 [JP] Japan ..... 59-133657

[51] Int. Cl.[4] ..... H01J 29/28; H01J 29/10

[52] U.S. Cl. ..... 313/466; 313/473

[58] Field of Search ..... 313/461, 466, 474, 473

[56] References Cited

U.S. PATENT DOCUMENTS 3,692,576 9/1972 Takayanagi et al. ..... 313/466 X 3,911,165 10/1975 Kanai et al. ..... 313/466 X 4,551,652 11/1985 Compen et al. ..... 313/466

FOREIGN PATENT DOCUMENTS 10658 1/1979 Japan ..... 313/466

*Primary Examiner*—David K. Moore

*Assistant Examiner*—K. Wieder

*Attorney, Agent, or Firm*—Hill, Van Santen, Steadman & Simpson

[57] ABSTRACT

The present invention relates to a cathode ray tube having a black matrix phosphor screen. In the cathode ray tube of the present invention, a film whose main component is oxide film is formed to cover a carbon layer of a black matrix formed on the inner surface of a face plate and a phosphor layer is formed on this film. Consequently, even if the carbon layer is thin, the carbon layer can be prevented from being burned and made white in the baking process so that a black matrix phosphor screen of high definition can be obtained. Thus, it is possible to provide a color cathode ray tube of high definition black matrix type type which is good in quality.

4 Claims, 10 Drawing Figures

CATHODE RAY TUBE HAVING AN ALUMINUM OXIDE FILM OVER A BLACK MATRIX

TECHNICAL FIELD

The present invention relates to cathode ray tubes and particularly to a phosphor screen of a black matrix-type color cathode ray tube.

BACKGROUND ART

As a cathode ray tube, there has been proposed a color cathode ray tube having a so-called black-matrix phosphor screen which is formed by filling a light absorbance property layer, for example, a carbon layer between respective color phosphor layers in order to improve the contrast. Generally, such black matrix phosphor screen is formed as follows. In this example, each phosphor layer is formed as a stripe shape. In the first place, a PVA (polyvinyl alcohol) photo-sensitive film is coated on the inner surface of a face plate of a cathode ray tube. This photo-sensitive film coated is exposed three times in response to red, green and blue colors by using the same exposing mask and then developed, thus a PVA stripe being formed. Then, after the carbon film is formed on the entire surface of the inner surface including the PVA stripe, the PVA stripe is dissolved, removed and a carbon stripe is formed on the portion corresponding to the portion between the PVA stripes. Next, a green phosphor slurry, for example, is coated on the entire surface of the inner surface, exposed via the exposing mask and developed to thereby form the green phosphor stripe. In like manner, a red phosphor stripe and a blue phosphor strip are formed hereinafter and thus the black matrix phosphor screen is formed.

By the way, as the cathode ray tube is arranged to become more and more high-definition one recently, it is requested to make the PVA photo-sensitive film thinner in order to obtain a thin carbon stripe whose side edge is sharp (so-called sharp edge). As a result, when the carbon film is thin, even if the PVA stripe is dissolved, the carbon film remains in the uncessary portion, obstructing the good carbon stripe from being obtained. Accordingly, unless the film thickness of the carbon film is made thin to such an extent that it can be peeled off by dissolving the thin PVA stripe, it is not possible to obtain the thin carbon stripe of which the side edge is sharp. However, the thin carbon stripe thus formed is burned through the succeeding baking process and then becomes white. In consequence, in the prior art, the carbon film can not be made thin to such extent that the good stripe can be obtained. Hence, it is difficult to obtain particularly a high definition black matrix phosphor screen.

In view of the above mentioned aspect, this invention is to provide a cathode ray tube in which the black matrix phosphor screen of high definition can be formed.

DISCLOSURE OF INVENTION

This invention relates to a cathode ray tube in which a film whose main component is aluminum oxide is formed on a carbon layer for a black matrix formed on the inner surface of a face plate and a phosphor layer is formed on this film layer. According to this invention, even if the thin carbon layer is formed, it is avoided that the carbon layer is fired and becomes white through the baking process. Accordingly, a thin carbon layer having a small width and a sharp side edge can be formed, a black matrix phosphor screen can be formed and hence a good cathode ray tube of high definition can be provided.

BEST MODE FOR CARRYING OUT THE INVENTION

An embodiment of a cathode ray tube according to the present invention will hereinafter be described with reference to the drawings.

Figure 1:
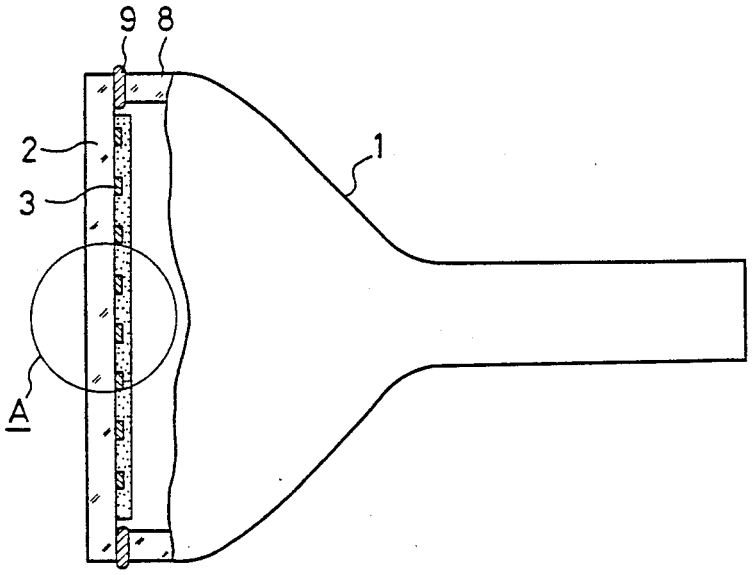
FIG. 1 is a partly cross-sectioned side view of a cathode ray tube according to the present invention.
Figure 2:
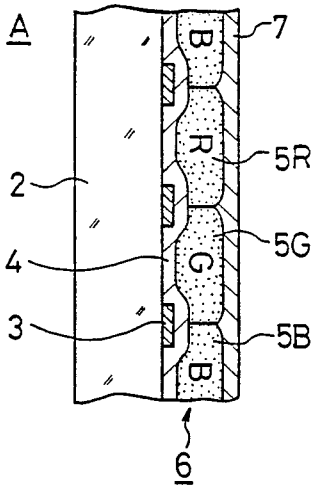
FIG. 2 is an enlarged view of a main part A of FIG. 1 and FIGS. 3A to 3H are process diagrams showing one example of a method for forming a phosphor screen of the present invention.

In the present invention, as shown in FIG. 1 and FIG. 2 (an enlarged view of a main part A of FIG. 1), on the inner surface of a face plate 2 of a cathode ray tube 1, there is formed a carbon stripe 3 of a black matrix. A film 4 whose main component is aluminum oxide is formed on the inner surface including the carbon stripe 3. On this film 4, there are formed red, green and blue phosphor stripes 5R, 5G and 5B to thereby form a so-called black matrix type color phosphor screen 6. Then, a metal back film layer 7 made of, for example, an A1 film is formed on this phosphor screen 6. Reference numeral 8 designates a funnel and 9 a frit sealed portion.

FIG. 3 is a process diagram showing one example of this phosphor screen forming method. In the first place, as shown in FIG. 3A, a PVA photo-sensitive film 11 is coated on the inner surface of the face plate 2 of the flat plate-shape, and exposed three times in accordance with red, green and blue colors by using an exposing mask 12. Then, it is subjected to the developing process and thereby PVA stripes 11' are formed at the positions corresponding to the red, green and blue phosphor layers that will be formed thereafter as shown in FIG. 3B.

Figure 3A:
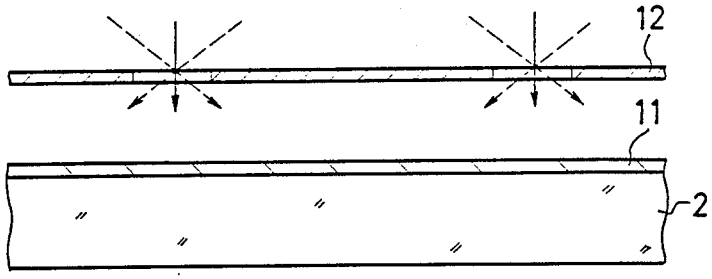
Figure 3B:
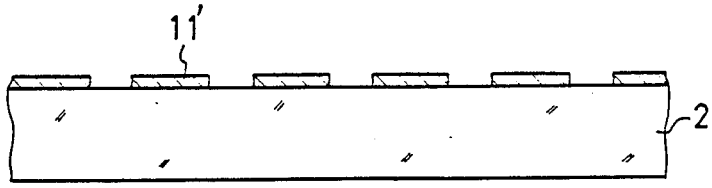
Figure 3C:
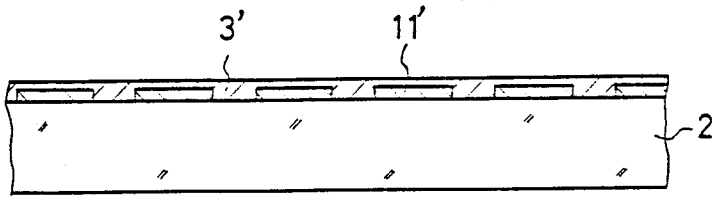
Figure 3D:
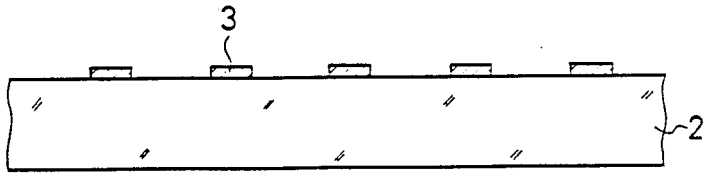

Next, as shown in FIG. 3C, a carbon film 3' is coated on the entire surface and the PVA stripe 11' is dissolved thereafter by, for example, hydrogen peroxide ($H_2O_2$) and the like to thereby remove only the PVA stripe 11' and the carbon film 3' formed thereon. As a result, the carbon stripe 3 is formed on the portion corresponding to the portion between the PVA stripes (see FIG. 3D). In this case, the film thickness of the carbon film 3' is desirably selected to be about 0.1 $\mu$m to 0.3 $\mu$m.

The carbon film is coated by spraying while the face plate is slowly rotated with its surface downward and thereafter, the face plate is rotated to thereby form the uniform film. In this case, since the flat plate-shaped face plate having no flange portion is employed, it is possible to make the coating film thickness to a predetermined thin thickness.

Figure 3E:
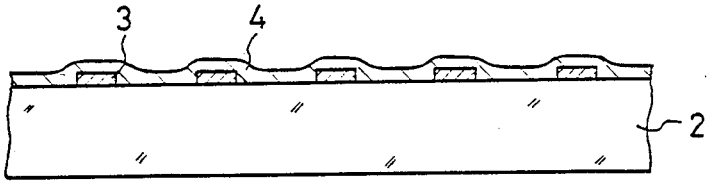
Figure 3E:
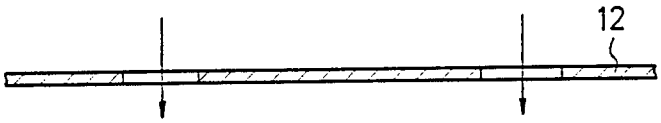

Then, as shown in FIG. 3E, an $Al_2O_3$ film 4 is deposited on the inner surface of the face plate including the carbon stripe 3. As this $Al_2O_3$ film 4, it is possible to use, for example, ALUMINAZOL-100 (product name) and ALUMINAZOL-200 (product name) manufactured by Nissan Chemical Industries Co., Ltd. The characteristics of the ALUMINAZOL are as follows:

| IN CASE OF THE ALUMINAZOL-100 | |
|---|---|
| $Al_2O_3$ (solid component) | 10 to 11 (weight percent) |
| specific gravity | 1.09 to 1.14 |
| particle powder type | feather-like state |
| size of particle powder | averaged as 100 μm × 10 μm |
| viscosity | 100 to 10000 (centipoise) |
| IN CASE OF THE ALUMINAZOL-200 | |
| $Al_2O_3$ (solid component) | 10 to 11 (weight percent) |
| specific gravity | 1.094 to 1.14 |
| particle powder shape | feather-like shape |
| size of particle powder | averaged as 100 μm × 10 μm |
| viscosity | 50 to 3000 (centipoise) |

The concentration of the ALUMINAZOL is selected to be desirably and is coated on the inner surface of the face plate on which the carbon stripe 3 is formed as the $Al_2O_3$ film 4 so as to have a film thickness ranging from 0.2 μm to 3 μm after being baked. It is baked at the temperature of 420° C. to 430° C. If the film thickness of the $Al_2O_3$ film 4 is less than 0.2 μm, it is not possible to prevent the carbon stripe from being made white by the firing. While, if it is more than 3 μm, a crack occurs in the $Al_2O_3$ film 4 in the baking process and this exerts a bad influence when the green, blue and red phosphor stripes are formed thereafter.

Figure 3F:
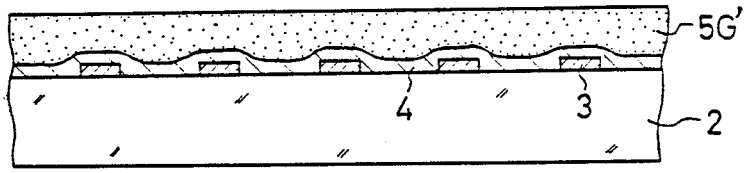
Figure 3G:
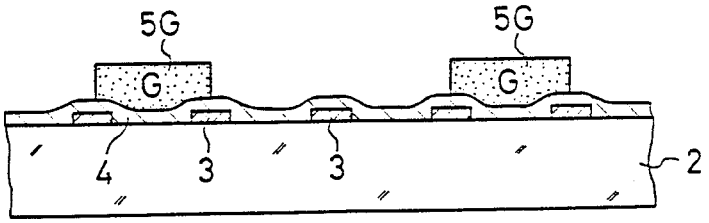
Figure 3H:
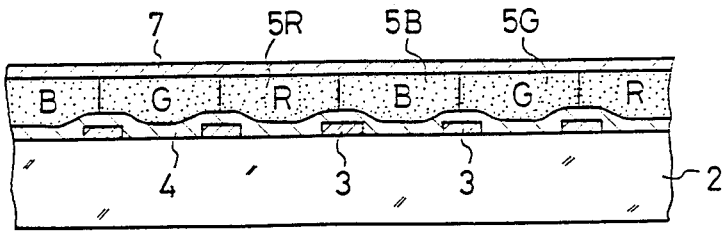

Next, as shown in FIG. 3F, a green phosphor slurry 5G', for example, is coated on the whole surface, exposed through the exposing mask 2 and developed to thereby form the green phosphor stripe 5G at the predetermined position on the $Al_2O_3$ film 4 (see FIG. 3G).

Thereafter, the similar process is repeated and thereby the blue phosphor stripe 5B and the red phosphor stripe 5R are formed, thus the black matrix color phosphor screen 6 being formed. Then, on the phosphor screen 6, there is coated a smoothing intermediate film (not shown) made of acrylic resin, thus forming a metal back film layer 7 made of Al film (see FIG. 3H). Thereafter, the face plate 2 is pre-baked (at a temperature ranging from 420° C. to 430° C.) and further, the face plate 2 and the funnel are frit sealed (at a temperature ranging from 420° C. to 430° C.). In this heat treatment, organic binders contained in the intermediate film and the phosphor stripes are exhausted away. Both the pre-baking and the frit sealing may be carried out by one baking process.

According to this arrangement, since the $Al_2O_3$ film 4 is formed on the carbon stripe 3, even after the baking process, the latter can be prevented from being baked and also prevented from being made white. Therefore, the thickness of the carbon film can be made adequately thin and it is possible to form the thin carbon stripe having a small width and a sharp side edge. Thus, it is possible to obtain a good high definition tube of the black matrix type with good quality.

Further, by this $Al_2O_3$ film 4, it is possible to avoid a browning phenomenon (browning) of the glass of the face plate due to the electron beam. In order to more effectively avoid this browning phenomenon, it is desirable that after the $Al_2O_3$ film having a film thickness less than 3 μm is formed, the $Al_2O_3$ film is coated once again and then the baking is carried out to thereby control the film thickess of the film.

While in the above mentioned example the present invention is applied to the phosphor screen formed of phosphor stripes, the present invention can also be applied to a black matrix phosphor screen which uses phosphor dots.

According to the present invention, since the film whose main component is $Al_2O_3$ is deposited on the carbon layer of the black matrix as set forth above, this film becomes a protecting film by which even after the baking process, the carbon layer can be prevented from being burned, so that even if the film thickness of the carbon layer is thin, the carbon layer can be prevented from being made white. Accordingly, since the thickness of the carbon layer is thin enough that can be peeled off by the thin PVA film, it is possible to form the carbon layer which is thin and has the sharp side edge. Therefore, the present invention is particularly suitable for being applied to a black matrix type color cathode ray tube of high definition type.

I claim:

1. A color television face plate for a color cathode ray tube comprising:

a matrix carbon layer composed of a discrete pattern of individual carbon deposits formed on the inner surface of said face plate, a transparent film composed primarily of aluminum oxide covering the entire said inner surface and covering said matrix carbon layer said film being of sufficient thickness to protect said matrix carbon layer against baking temperatures, a luminescent material layer formed on said film, and a metal backing layer formed on said luminescent material layer.

2. A face plate according to claim 1 wherein said matrix carbon layer is in the form of parallel strips.

3. A face plate according to claim 1 wherein the thickness of said film of aluminum oxide is from 0.2 to 3 microns.

4. A face plate according to claim 2 wherein said luminescent layer consists of alternating green, blue and red emitting phosphors, the boundaries between adjoining phosphors lying directly behind said parallel strips.

* * * * *